US008020437B2

(12) United States Patent
Zhan et al.

(10) Patent No.: US 8,020,437 B2
(45) Date of Patent: Sep. 20, 2011

(54) METHOD AND APPARATUS TO QUANTIFY FLUID SAMPLE QUALITY

(75) Inventors: Lang Zhan, Pearland, TX (US); Dhandayuthapani Kannan, Missouri City, TX (US); James G. Filas, Saint Cloud (FR); Graham Birkett, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 613 days.

(21) Appl. No.: 11/768,403

(22) Filed: Jun. 26, 2007

(65) Prior Publication Data

US 2009/0000785 A1 Jan. 1, 2009

(51) Int. Cl.
*E21B 47/06* (2006.01)

(52) U.S. Cl. ..... 73/152.22

(58) Field of Classification Search ..... 73/152.02, 73/152.05, 152.41, 152.51; 166/250.02, 166/264

See application file for complete search history.

(56) References Cited

U.S. PATENT DOCUMENTS

| | | | | | |
|---|---|---|---|---|---|
| 4,513,612 | A | * | 4/1985 | Shalek | 73/152.24 |
| 4,776,210 | A | * | 10/1988 | Baillie et al. | 73/861.04 |
| 4,994,671 | A | | 2/1991 | Safinya | 250/255 |
| 5,167,149 | A | | 12/1992 | Mullins | 73/152.42 |
| 5,201,220 | A | | 4/1993 | Mullins | 73/152.42 |
| 5,266,800 | A | | 11/1993 | Mullins | 250/256 |
| 5,306,909 | A | | 4/1994 | Jones | 250/255 |
| 5,331,156 | A | | 7/1994 | Hines | 250/256 |
| 5,458,192 | A | * | 10/1995 | Hunt | 166/250.1 |
| 5,663,559 | A | | 9/1997 | Auzerais | 250/269.1 |
| 5,799,733 | A | * | 9/1998 | Ringgenberg et al. | 166/264 |
| 5,859,430 | A | | 1/1999 | Mullins | 250/255 |
| 5,934,371 | A | | 8/1999 | Bussear | 166/53 |
| 5,939,717 | A | | 8/1999 | Mullins | 250/255 |
| 6,058,773 | A | * | 5/2000 | Zimmerman et al. | 73/152.24 |
| 6,178,815 | B1 | | 1/2001 | Felling | 73/152.19 |
| 6,343,507 | B1 | | 2/2002 | Felling | 73/152.19 |
| 6,437,326 | B1 | | 8/2002 | Yamate | 250/269.1 |
| RE38,129 | E | * | 6/2003 | Kleinberg | 73/152.18 |
| 6,799,117 | B1 | | 9/2004 | Proett | 702/12 |
| 6,966,234 | B2 | | 11/2005 | Carnegie | 73/863.21 |
| 7,095,012 | B2 | | 8/2006 | Fujisawa | 250/269.1 |
| 7,178,591 | B2 | | 2/2007 | Del Campo | 166/264 |
| 7,369,979 | B1 | * | 5/2008 | Spivey | 703/8 |
| 2005/0119911 | A1 | * | 6/2005 | Ayan et al. | 705/1 |
| 2005/0240349 | A1 | * | 10/2005 | Goswami et al. | 702/6 |
| 2006/0241867 | A1 | * | 10/2006 | Kuchuk et al. | 702/13 |
| 2009/0294122 | A1 | * | 12/2009 | Hansen et al. | 166/250.01 |

* cited by examiner

*Primary Examiner* — Hezron Williams
*Assistant Examiner* — Tamiko D Bellamy
(74) *Attorney, Agent, or Firm* — Kevin B. McGoff; Rodney V. Warfford

(57) ABSTRACT

The invention relates to fluid sampling in a test that is used to determine physical and chemical characteristics of the fluids in a subterranean reservoir. The method reconstructs the entire pressure history of the fluid parcel that is captured in the fluid samplers during a test. Using this reconstructed pressure history of the samples, the quality of the samples, particularly, whether there is a phase change in the samples during the test, can be accurately quantified.

23 Claims, 6 Drawing Sheets

SANDFACE SHUT-IN AT t = 104, 114 AND 145 SECONDS FOR PERMEABILITY OF 1800 md, 400 md AND 100 md, RESPECTIVELY.

SANDFACE SHUT-IN AT t = 104, 170 AND 250 SECONDS FOR PERMEABILITY OF 1800 md, 50 md AND 25 md, RESPECTIVELY.

METHOD AND APPARATUS TO QUANTIFY FLUID SAMPLE QUALITY

TECHNICAL FIELD

The present application relates to testing, and more particularly, to testing in a downhole hydrocarbon well environment.

BACKGROUND OF THE INVENTION

In the following description, numerous details are set forth to provide an understanding of the present invention. However, it will be understood by those skilled in the art that the present invention may be practiced without many of these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Well/formation testing is one of the primary techniques to explore subsurface formation properties. A typical objective of a well/formation test includes measuring bottom-hole pressure (BHP) or flowline pressure transient during flowing and shutting-in of the well/pump as well as capturing representative reservoir fluid samples. The BHP or flowline pressure history can be used to infer formation permeability or productivity, damaged skin factor and initial reservoir pressure. The reservoir fluid samples are used in laboratory to measure the fluid properties, such as viscosity, compressibility, gas-oil-ratio, formation volume factor etc. Because these fluid properties play a major role in determining reservoir performance and designing optimum field operations, high quality reservoir fluid properties are needed in reservoir management. That, in turn, requires high quality representative fluid samples from a well/formation test.

The reservoir fluid sampling is usually conducted through a wireline formation tester (WFT) or a dedicated sampling operation in a large scale well test called Drill Stem Test (DST). There are two major issues that affect the quality of fluid samples taken by either WFT or DST in the fluid sampling. The first is contaminations of mud (or completion) filtrates in the samples. The second is unwanted phase change in the samples during the test as the samples may experience a pressure below the bubble or dew point pressure before they are captured. Mud filtrates exist because of over-balanced pressure differential between the wellbore and formation during drilling operations. If the filtrates are not completely removed or separated from the virgin reservoir fluids before the samples are taken, the quality of the samples can be compromised. Gas vaporization or condensates drop out when the fluid pressure goes below the bubble or dew point, leading to phase change in the fluid samples. If the samples are contaminated or non-representative components are present in the samples, inaccurate measurements of the fluid properties can result. WFT and DST both have advantages and limitations in dealing with the above two difficulties in fluid sampling.

A wireline formation tester, such as the Modular Formation Dynamic Tester™ (MDT), available from Schlumberger Technology Corporation, is often used to take the fluid samples soon after a well is drilled. The formation tester uses either a dual-packer to isolate a small segment of the wellbore or a probe against the wellbore sandface. A pump installed in the tool string withdraws formation fluids through the dual packer or the probe into a flowline of the tool. Because drilling mud filtrate exists in the near wellbore region, the initial fluids pumped in the flowline are mostly filtrates rather than virgin formation fluids. The characteristics of the fluids in the flowline can be monitored by various sensors installed in the flow channels in the tool string. For example, an optical density sensor, as described in the U.S. Pat. Nos. 4,994,671, 5,266,800 and 6,966,234, may be used to distinguish the filtrates and formation fluids. If the filtrate level is high, the produced fluids are dumped into the wellbore and pumping out is continued. If the contamination level is below an acceptable level, the withdrawn fluids are diverted into a sampler to capture the fluid sample. Because mud filtrates usually still exist during the pumping out stage, it is very difficult to obtain contamination free fluid samples even using a guarded probe that is available from Schlumberger Technology Corporation and is described in the U.S. Pat. No. 7,178,591. However, real time communication and data transmission are available in WFT, the bottom-hole pressure can be continuously monitored. In most cases, flow rate can be reduced to accommodate single phase sampling requirements in order to maintain the fluid pressure above the bubble point or dew point pressure. Therefore, WFT has better capability to control fluid pressure in a flowline above the bubble or dew point in most conditions so that single gas or liquid phase sampling can be obtained, but mud contamination is more difficult to overcome.

Drill stem test (DST) is another technology often used in fluid sampling. A variety of testing tools including fluid samplers are installed at the lower end of working pipes that are run into the bottom of the wellbore and are set close to the formation to be tested. Formation fluids are induced into wellbore, working string and even on the surface while the BHP is recorded during the flowing and subsequent shutting in periods of the well test. A dedicated flowing period is often carried out at the end of the test to capture formation fluid samples. Because wireline or other types of communications usually are not available for a DST, it is difficult to monitor the compositions of fluids or pressure condition inside the wellbore before taking the samples. However, since working pipes are used in the test, a large quantity of formation fluids can be produced into wellbore, working pipe or on the surface. If the produced formation fluid volume is sufficiently large, the mud filtrates can be completely removed from the well before representative fluid samples are captured. Contrary to WFT, a very low level of, even no, contamination in fluid samples may be achieved in a DST. Thus, while DST is capable of obtaining contamination free fluid samples it is generally difficult to know whether there ever was/is gas vaporization or condensate in the fluids during the sampling operation because of an absence of the real time monitoring.

Sometimes, even though the captured fluid samples do not have vaporized gas or gas condensate, it does not guarantee the samples have representative components as the virgin reservoir fluids. The reason is that the formation pressure might decrease below the bubble or dew point before the time of the sampling. For some test operations, the wellbore pressure has the lowest value at the initial time of production and then continuously increases during the later production and well shutting-in. For example, during a closed chamber test (CCT) or during a slug test of a DST, the initial wellbore pressure can be quite small resulting from a small liquid cushion used in the test. Depending on formation and fluid properties, the reservoir fluid deep inside the formation may also experience a low pressure, which may cause gas vaporization or liquid condensate to drop out. Since more and more formation fluids move into wellbore as the test progresses, the hydrostatic pressure inside wellbore increases along with the rising liquid cushion column. The wellbore pressure at the late time of the test may return to pressures that are higher than the bubble or dew point pressure. At the time of the sampling, the wellbore pressure is higher than the bubble or dew point, so single phase samples can be obtained. However, because the fluid samples have experienced pressure below the bubble or dew point at the initial test time, the composition of the samples may still be compromised.

In some other situations, the opposite may be true. In other words, even though the wellbore pressure at the initial test time is below the bubble or dew point, the pressure of the captured samples may not have gone below the critical pressure in a CCT or a slug test. The reason is that the wellbore pressure progressively increases during the test and the sampling is conducted at a time toward the end of the test, during which the wellbore pressure has already increased above the bubble or dew point pressure. The fluid parcel that experiences pressure below the bubble or dew point at the early test time is lifted to the upper portion of the working pipes or even to the surface. The samples captured in the samplers at the time toward the end of the test may not have experienced any pressure below the bubble or dew point. Thus, the captured samples are still high quality.

Currently, existence or absence of the phase change in the samples is only qualitatively judged by the bottom-hole pressure measurements. The above analysis indicates that quantifying whether there is phase change in the captured samples in many test operations, especially, in CCTs and slug tests, is a complicated issue. In general, the quality of the samples cannot be quantified directly based on the bottom-hole pressure in a well test or flowline pressure in WFT since the samples taken into the samplers may have experienced very complex and different pressure history. Continuous improvement in relation to that area is needed.

The present application addresses the discussion so far herein and many, if not all, of the related drawbacks and associated issues. A detailed description of some embodiments follows herein.

SUMMARY

Some aspects of this application relate to a method to quantify the quality of a fluid sample in a downhole flow channel of a wellbore and tool string as well as an associated formation. That method comprises measuring a bottom hole or flowline pressure; obtaining formation properties including at least one selected from the following list: initial reservoir pressure, formation permeability, and skin factor; reconstructing a pressure history of a fluid sample parcel based on at least the obtained formation properties; and judging whether the pressure history of the fluid sample parcel has ever dropped below a bubble or a dew point.

That subject matter, among other subject matter relating to that and other embodiments, follows herein.

BRIEF DESCRIPTION OF THE DRAWINGS

The figures herein illustrate embodiments of various combinations of features relating to the invention, and should not be interpreted as limiting the scope of the claims recited herein.

DETAILED DESCRIPTION OF PREFERRED EMBODIMENTS

A primary desire for the fluid sampling in a well/formation test is to take fluid samples as close to the original formation fluids as possible. There are two major issues for both WFT and DST in the fluid sampling: (a) contaminations of mud (or completion) filtrates in the samples; (b) unwanted phase change in the samples during the test as the samples may experience pressure below the bubble or dew point pressure before they are captured. The mud filtrate contaminations can be monitored from an optical sensor in WFT and they may be completely removed by producing a large volume of the formation fluid in a DST. Thus, the first issue is solvable. The second issue is more subtle and requires more careful analysis. Bottom-hole pressure and a variety of other measurements are available for both WFT and DST. The bottom-hole pressure can be used to qualitatively analyze the quality of the captured samples. If the BHP is higher than the critical pressure at the time of the sampling, the samples are believed to be representative. As pointed out before, the pressure of the fluid samples may undergo a different variation history from the bottom hole wellbore pressure. Thus, quantifying the quality of the fluid samples directly from the BHP value at the time of the sampling is not the most reliable technique.

Accordingly, an embodiment of the present application proposes a method to quantify the fluid sample quality, especially, the existence or absence of the phase change, based on an accurately reconstructed history of the captured samples in the test.

Figure 1:
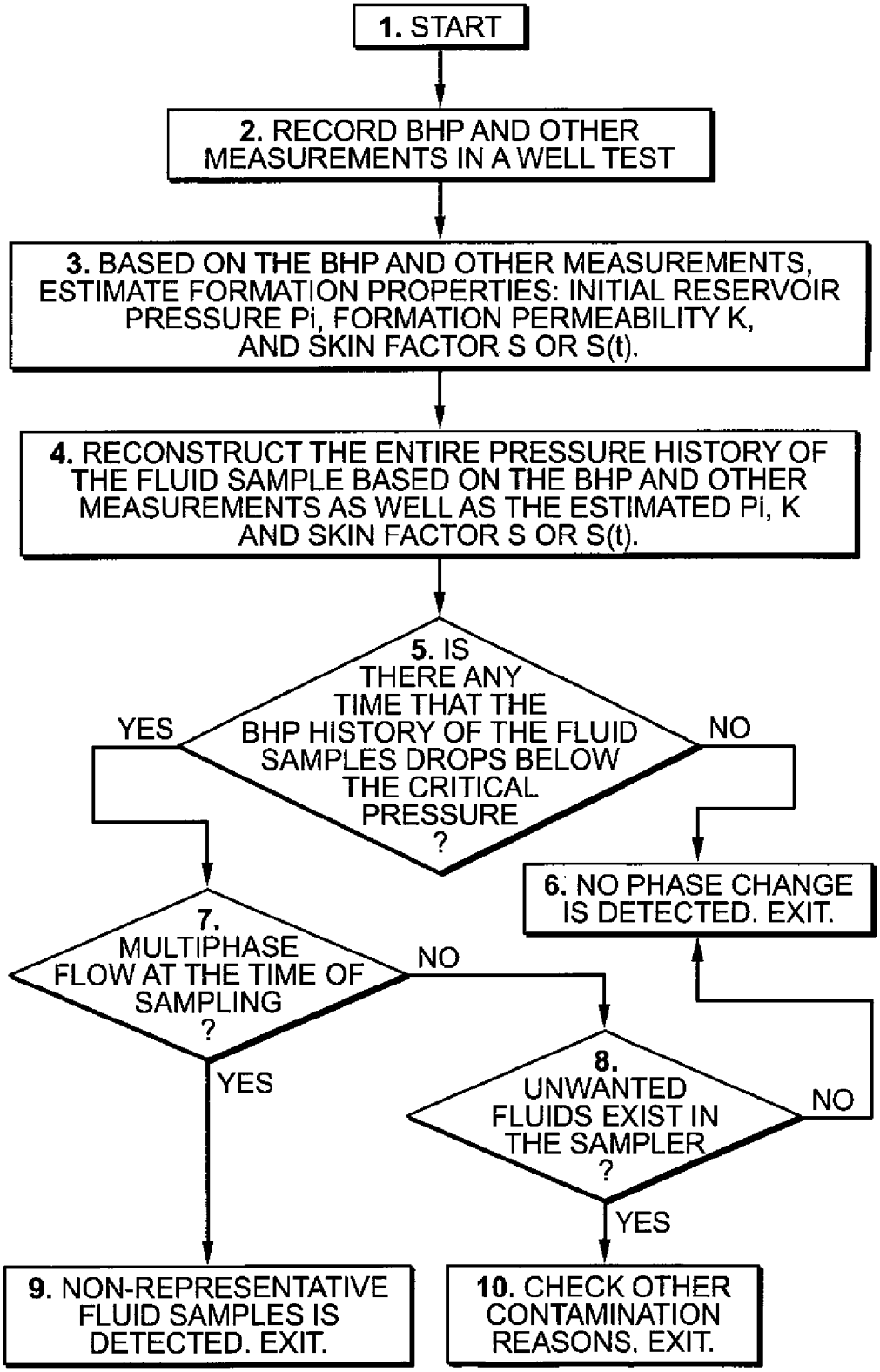
FIG. 1 illustrates a flowchart that is used to quantify the fluid sample quality.

FIG. 1 shows a flowchart according to an embodiment, for the purpose of quantifying whether or not a phase change exists in fluid samples captured in a well test.

The analysis starts from taking the BHP and other necessary measurements in step 2. Depending on the test operations and methods, the other measurements may include flow rate measurements and pressure measurements at other locations etc. For example, the hydraulic pump out volume is obtained from MDT pumping strokes so that the flow rate during the wireline formation test can be calculated. The flow rate can also be calculated from the pressure measurements in the air chamber in a CCT or can be measured at down-hole or surface for a conventional DST. Ideally, the minimum requirement for the data acquisition is that combining all the measurements, it should be able to determine the key formation properties that are needed in following steps in the flowchart.

The second step 3 is to obtain formation properties, which can include initial reservoir pressure, formation permeability, skin factor (a constant or a time varying result) etc., from the data recorded in the first step 2 of the flowchart. The interpretation methods used in that step again depend on the actual test operations. Pressure data in a conventional well test can be analyzed to estimate these formation properties by various analysis techniques documented in standard well test texts, such as the monograph by Earlougher, entitled "Advances in well test analysis", published in 1977 by Society of Petroleum Engineers. For wireline formation testing, Interval Pressure Transient Testing (IPTT) method, which is disclosed in the US patent publication 20060241867, can be utilized to analyze the WFT pressure measurements for formation parameter estimation. For a CCT or surge test, the methods disclosed in the U.S. patent application Ser. No. 11/674449 may be used to infer these formation properties.

The third step 4 of the flowchart is to reconstruct essentially the entire pressure history of the fluid samples based on the formation properties obtained from the previous pressure data interpretation. The detailed implementations of this step and the related modeling methods will be given later.

Based on the reconstructed pressure history of the fluid sample in the test, a judgment is made whether the pressure history of the fluid sample has ever dropped below the bubble or dew point. If not, the steps proceed to step 6 where no phase change is detected and the process is exited. If yes, the steps go forward to step 7.

At step 7, it is checked whether there is/was multiphase fluid at the time of the sampling. If multiphase flow is/was present, a non-representative sample is detected at step 9. If not, the process proceeds to step 8.

Step 8 verifies whether there are possible unwanted fluids in the actual captured sample. If there are not, then the process proceeds to step 6 where no phase change is detected and the process is exited. If yes, then the process proceeds to step 10 where if the detection is not conclusive, the process is exited and other possible contamination reasons are checked.

Step 4 is a primary step in the above workflow. It involves an integrated simulation, which consists of at least the following three components: (a) modeling fluid transport in reservoir; (b) modeling fluid transport model in flow channel inside wellbore and tool string; and (c) tracking the locations and pressures of the fluid sample parcel from the formation to the sampler.

The type of a suitable fluid transport model for in reservoir depends on fluid characteristics of the reservoir in a well test. Many commercial reservoir simulators, for example, Eclipse Simulator™, available from Schlumberger Technology Corporation, can be used for this purpose. Those commercially available reservoir simulators are able to handle various reservoir conditions, such as dry gas, wet gas, volatile oil, black oil and heavy oil reservoirs. Alternatively, a dedicated reservoir model can be utilized to simulate the fluid transport in the formation based on the characteristics of the reservoir. In the following, an exemplary model to handle the simulation of the formation fluid flow in a homogeneous reservoir is presented. Other models with slightly different formulae can be used if the reservoir has different characteristics.

According to an embodiment, it is assumed that the reservoir model has the following features: (a) the formation is homogeneous and isotropic; (b) there is a uniform height of formation; (c) the force of gravity is negligible; (d) the fluid is slightly compressible; (e) there is radial 1-D flow; and (f) that Darcy's law is applicable. These assumptions lead to a governing equation in the reservoir:

$$\frac{1}{r}\frac{\partial}{\partial r}\left(r\frac{\partial p}{\partial r}\right) = \frac{\mu\phi c_i}{k}\frac{\partial p}{\partial t} \tag{1}$$

Initial condition:

$$p(t=0)=p_i \tag{2}$$

Outside boundary condition:

$$\left(\frac{\partial p}{\partial r}\right)_{r=r_e} = 0 \tag{3}$$

In equations (1), (2) and (3), "$p_i$" represents the initial reservoir pressure; "μ" represents the formation fluid viscosity; ϕ represents the formation porosity, k represents the average formation permeability, and "$c_t$" represents the total compressibility of the fluid dynamic system.

The second component of the method to reconstruct the pressure history of the fluid sample is a wellbore model to simulate fluid dynamic inside borehole during the test. The general wellbore model can be expressed by the following mass and momentum governing equations:

$$\frac{\partial}{\partial t}(A\rho_w) + \frac{\partial}{\partial z}(A\rho_w v) = \hat{q}_{prod}[S(z=0) - S(z=h)], \tag{4}$$

$$\frac{\partial}{\partial t}(A\rho_w v) + \frac{\partial}{\partial z}(A\rho_w v^2) = -A\frac{\partial p}{\partial z} - F_f - A\rho_w g, \tag{5}$$

where "$\rho_w$" represents the density of wellbore fluid; "V" represents the velocity; "A" represents the cross-section area of the flow channel; "$F_f$" represents the friction force; "$\hat{q}_{prod}$" represents the production rate per unit length of the producing formation; "S" represents the step function; "h" represents the thickness of the producing zone. Note that we assume there is no "rat hole" in the well in the derivations of this invention. However, the spirit of the derivation is valid for the case where a "rat hole" exists. A variety of simplified wellbore models can be derived from the general formulae in Eqs. (4) and (5). For example, if the density of wellbore fluid $\rho_w$ does not vary substantially, it can be assumed to be a constant. In most situations, the cross-section area of the working pipe is constant. Based on those two assumptions, Eqs. (4) and (5) can be greatly simplified so that the entire liquid column in the wellbore is treated as an incompressible fluid with the same moving speed. Therefore, the velocity of the fluid in the wellbore does not change with the height and the Eq. (5) reduces to an ordinary differential equation rather than a partial differential equation. While such simplification makes the simulation much faster, it also suffers from inaccuracy in the bottom-hole pressure calculation. According to embodiments of the present invention, a variable fluid density in the wellbore and formation is preferred. This requires the equation of state (EOS) for the fluid in the wellbore. A preferred formulation of the EOS is written as $$\rho(p)=\rho_r \exp[c_f(p-p_r)] \tag{6}$$

where $\rho_r$ is the value of the fluid density at the reference pressure $p_r$, and $c_f$ is the compressibility factor of the fluid. The compressibility factor can be either a constant or a variable of pressure. The latter is further defined below:

$$c_f(p)=c_{fr} \exp[c_c(p-p_r)] \tag{7}$$

where $c_{fr}$ is the value of the compressibility factor at the reference pressure $p_r$, and $c_c$ is a constant. Expressions (6) and (7) are substituted in the equations (4) and (5) to remove the fluid density from the variable list.

The reservoir and wellbore dynamic models given in the equations (1), (4) and (5) require coupling conditions in order to solve them simultaneously. From the wellbore and reservoir material balance and pressure continuity, the coupling equations can be written as $$\pi r_p^2 v(z=h)=\hat{q}_{prod}h=\frac{2\pi rkh}{\mu}\left(r\frac{\partial p}{\partial r}\right)_{r=r_w} \tag{8}$$

and $$p_w\left(t, z=\frac{h}{2}\right)=\left[p(t)-s\left(r\frac{\partial p}{\partial r}\right)\right]_{r=r_w} \tag{9}$$

where $r_p$ represents the radius of the working pipe, s represents the skin factor and $p_w$ represents wellbore pressure. If the skin factor varies with time, a skin model disclosed in the U.S. patent application Ser. No. 11/674449 may be used in the simulator, i.e.

$$s(t)=\begin{cases}\dfrac{(s_I-s_E)}{[1-\exp(-\lambda)]}\left[\exp\left(-\dfrac{\lambda t}{t_s}\right)-\exp(-\lambda)\right]+s_E \\ s_E\end{cases} \tag{10}$$

where "λ" represents a constant, "$s_I$" and "$s_E$" represents initial and ending skins factors, respectively, in a well test within a characteristic interval of time, "$t_s$," during which the skin effect factor substantially varies.

Discretizing the above equations, the pressure distribution inside formation, pressure distribution and fluid velocity inside wellbore can be simulated. Other fluid flow properties can be calculated based on these pressure and velocity results. A major difficulty of reconstructing the entire pressure history of the fluid sample is that the location of the fluid sample in the formation at the beginning of the test is not known. One solution according to embodiments is to use a Lagrangean technique, in which the pressure histories of essentially all discretized fluid parcels in the system are tracked at essentially all times during the simulation. The pressure history of the parcel that reaches the sampler at the time of the fluid sampling is the result that is looked for. That technique requires intensive computational resources as very fine grids in the formation and wellbore are needed to more accurately track the pressure history of essentially all parcels in the flow region. According to embodiments, an alternative technique can be implemented, in which two separate runs are conducted for the purpose of reconstructing the pressure history of the fluid sample.

Figure 2:
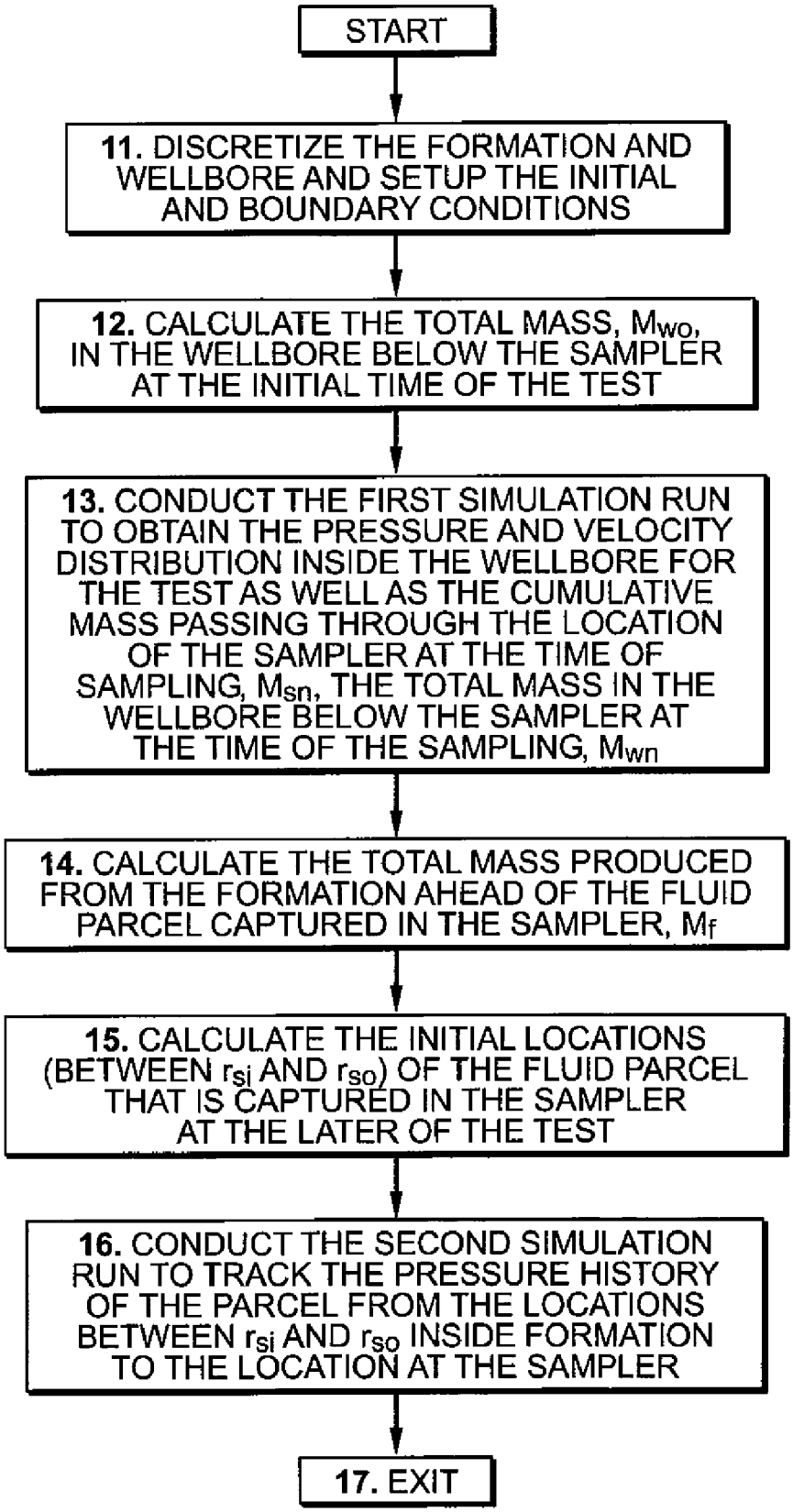
FIG. 2 illustrates a flowchart of a two-run approach to reconstruct the entire pressure history of the fluid sample.

FIG. 2 illustrates an embodiment of a two-simulation-run technique for the pressure history reconstruction. The primary goal of the process shown in FIG. 2 is to obtain the location of a fluid parcel, which is in the formation at the beginning of the test and is captured in the later time of the test. According to embodiments, if the location of the fluid parcel at the beginning of the test is known then the pressure history of the parcel can be tracked during the subsequent test time along with its moving from the formation into the wellbore.

The first step 11 in FIG. 2 is to setup appropriate boundary and initial conditions as well as discretization of the formation and wellbore in order to obtain accurate simulation results.

From the initial hydrostatic pressure distribution before the test, the total mass in the wellbore below the sampler at the initial time of test, $M_{wo}$, is calculated in step 12:

$$M_{wo}=\int_0^{z_s}\rho_w(p,0)A(z)\,dz \tag{11}$$

where $\rho_w(p,0)$ is the initial density distribution that can be determined from expressions (6) and (7) using the initial wellbore condition, A(z) is the cross-section area in the wellbore, and the $z_s$ is the height of the fluid sampler.

The third step 13 in FIG. 2 is to conduct the first full simulation run from the beginning to the end of the test using the numerical simulator. Because the pressure and velocity distributions both inside formation and borehole are obtained at each time step in the simulation, the cumulative mass passing through the location of the sampler at the time of the sampling, $M_{sn}$, and the total mass in the wellbore below the sampler at the time of the sampling, $M_{wn}$, can be calculated:

$$M_{sn}=\int_0^n \rho_s v_s A_s\,dt=A_s\sum_{i=0}^{n}\rho_{si}v_{si}\Delta t_i \tag{12}$$

and $$M_{wn}=\int_0^s \rho_w(p,t_n)A(z)\,dz \tag{13}$$

where $\rho_s$, $v_s$ and $A_s$ are the fluid density, velocity and flow channel cross-section area of the tool string at the location of the sampler, respectively, $t_0$ and $t_n$ are the initial time and the time at the sampling, respectively, and $\rho_w(p,t_n)$ is the fluid density distribution in the wellbore at the time of the sampling. If the test at $t_0, t_1, t_2, \ldots, t_n$ is simulated, the integral in (12) can be simplified by the summation at the right hand side.

The total mass of the formation fluid moving above the sampler at the time of the sampling, $M_{sf}$, is calculated in the next step 14.

$$M_f=M_{sn}-M_{w0} \tag{14}$$

In Eq. (14) it is assumed that all wellbore fluid below the sampler at the beginning of the test has been lifted above the sampler at the time of sampling. The cushion fluid falling down is possible for a conventional surge test because it is generally heavier than formation fluids and the bottom-hole testing valve is not closed at an appropriate time. However, if the optimum down-hole valve closure technique disclosed in US patent publication 20070050145 is implemented, the cushion fluid falling down can be avoided in that the bottom-hole testing valve is closed before the up-moving wellbore fluid completely stops.

The total mass $M_f$ originally resides in the formation. Based on $M_f$, the location of the fluid sample parcel can be calculated in step 15. Assuming homogeneous reservoir with uniform thickness h, the inner radius of the fluid parcel in the formation at the initial time of the test can be expressed by:

$$r_{si} = \sqrt{\frac{M_f}{\pi\phi h\rho_r(0)}} \tag{15}$$

where $\rho_r(0)$ is the initial fluid density inside the formation before the test starts. Assuming the volume of the fluid sampler $V_s$, the total mass in the sampler is $V_s\rho_{sn}$. There $\rho_{sn}$ is the fluid density at the location of the sampler at the time of the sampling. Then, the outer radius of the fluid parcel in the formation at the initial time of the test is written as:

$$r_{so} = \sqrt{\frac{M_f + V_s\rho_{sn}}{\pi\phi h\rho_r(0)}} \tag{16}$$

The fluid parcel that is captured in the sampler is located between $r_{si}$ and $r_{so}$ in the formation at the initial time of the test. The volume of the sampler in a well test is usually about several hundred cubic centimeters (or 0.2 gallon), i.e., $V_s\rho_{sn}$ is very small compared to $M_f$, the produced formation fluid before the fluid sampling in a test using WFT, DST or CCT. Therefore, the difference between $r_{si}$ and $r_{so}$ is negligible. If not, the average value of the $r_{si}$ and $r_{so}$ can be used for the representative location of the fluid parcel. In the following, $r_{si}$ is utilized to represent the location of the fluid parcel. Note that there is no need to track pressures and locations of all discretized parcels in all simulation times in this run. The results from (11) to (16), which are obtained at each time step, require very limited memory resources.

After $r_{si}$, the location of the fluid parcel that is captured in the sampler is obtained, the second simulation run is carried out in step 16 to calculate the pressure history of the parcel during its move from the formation to the sampler for the test. At each time step of the second simulation run, the location of the $r_{si}$ is tracked based on the mass balance requirement. From the updated $r_{si}$ at each time step, the representative pressure of the fluid parcel is simulated. After the entire pressure history is obtained, the second simulation run is exited in step 17.

Figure 3:
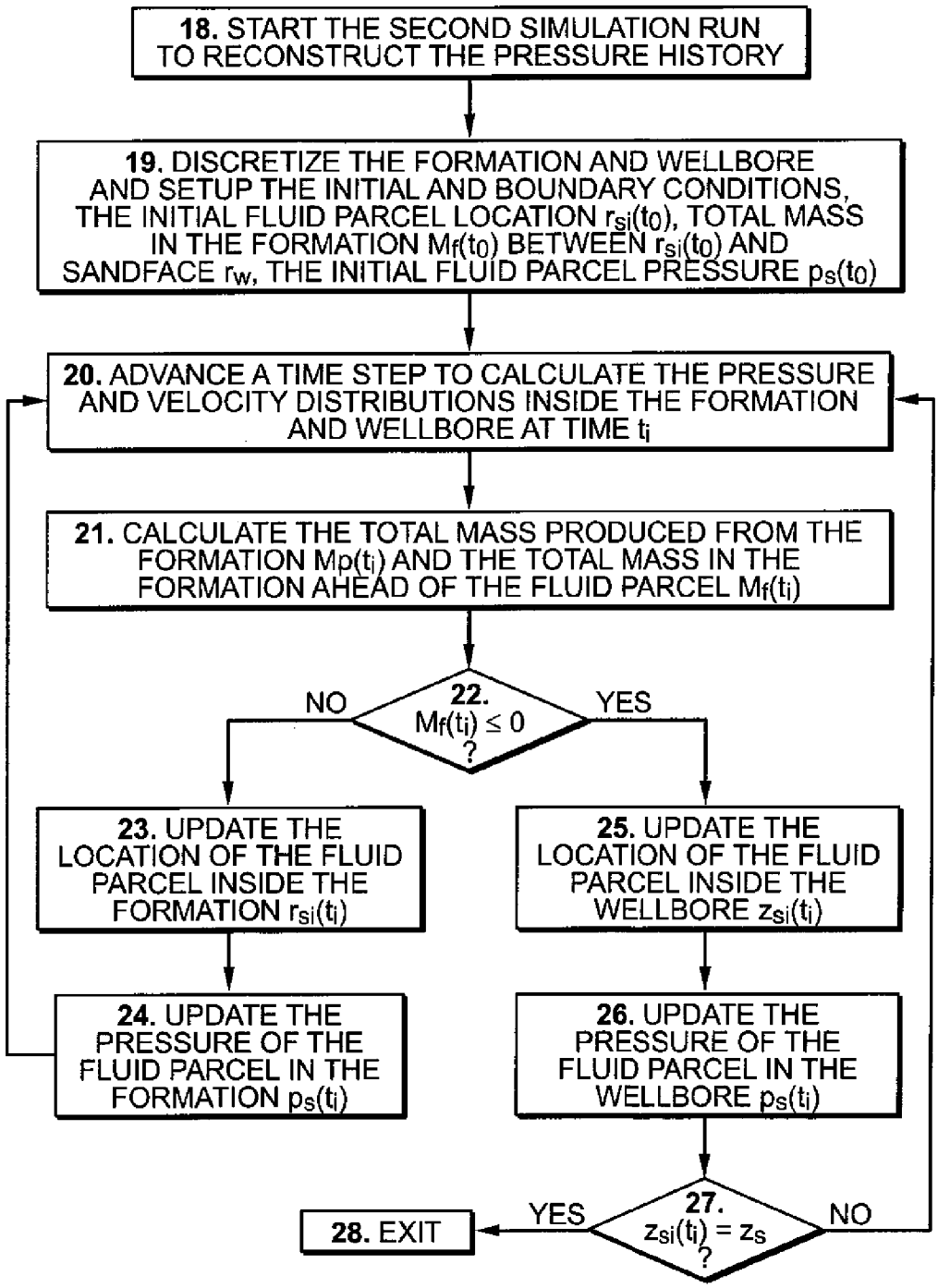
FIG. 3 illustrates a flowchart showing a second simulation run to reconstruct the entire pressure history of the fluid sample.

FIG. 3 outlines the detailed procedures used in the second simulation run of the step 16 for the pressure history reconstruction. After the second simulation starts in step 18, the formation and wellbore are discretized in step 19, which is similar to the first simulation run. The second run may use the same grids inside the formation and wellbore as the first, but such is not necessary. Preferably, fine grids are utilized in both runs in order to more accurately track the pressure history of the fluid parcel. The initial fluid parcel location $r_{si}(t_0)$, total mass in the formation $M_f(t_0)$ between $r_{si}(t_0)$ and sandface $r_w$, and the initial fluid parcel pressure $p_s(t_0)$ are obtained from the initial reservoir and wellbore conditions.

The simulation goes forward in one time step in step 20. The pressure and velocity inside the formation and wellbore at the corresponding time step $t_i$ are calculated.

Based on the results in step 20, the total mass produced from the formation $M_p(t_i)$ and the total mass in the formation ahead of the fluid parcel $M_f(t_i)$ at the time $t_i$ are calculated in step 21:

$$M_p(t_i) = \int_{i-1}^{t_i}\int_0^h \hat{q}_{prod}(t_i)\rho(p, t_i)dz\,dt + M_p(t_{i-1}) \tag{17}$$

$$M_f(t_i)=M_f(t_0)-M_p(t_i) \tag{18}$$

The $M_f(t_i)$ is the total mass that is still leftover in the formation between the sample parcel location $r_{si}$ and the sandface $r_w$.

Step 22 checks whether $M_f(t_i)$ is positive, zero, or negative. If positive, the sample parcel is still inside the formation and the method uses step 23 to calculate the new location of the sample parcel $r_{si}(t_i)$. If the formation is discretized into grid radii at $r_0, r_1, \ldots, r_N$, and $r_{si}(t_i)$ is between the grids $r_{m-1}$ and $r_m$ at the time $t_i$, the $r_{si}(t_i)$ can be obtained from the following mass balance equation:

$$M_f(t_i) = \sum_{j=1}^{m-1}\pi h(r_j^2 - r_{j-1}^2)\rho_{j-1,j}(t_i) + \pi h[(r_{si}(t_i))^2 - r_{m-1}^2]\rho_{m-1,m}(t_i) \tag{19}$$

where $\rho_{j-1,j}(t_i)$ is the formation fluid density between the grids $r_{j-1}$ and $r_j$. The pressure history of the fluid parcel at $r_{si}(t_i)$ is subsequently updated using interpolation based on the pressures at the grids $r_{m-1}$ and $r_m$ in the formation in step 24. After the updated location and pressure history of the fluid parcel are obtained, the method repeats the simulation of the next time step in step 20.

If $M_f(t_i)$ in step 22 is determined to be close to zero within some very small magnitude, the front of the parcel can be regarded at the sandface $r_w$ at the time $t_i$. The pressure value at the wellbore sandface $r_w$ is directly used for the pressure of the fluid parcel. If $M_f(t_i)$ was positive in the previous time step and turns to negative at the time $t_i$, the time step of the simulation is reduced and the simulation is repeated using the smaller time step until $M_f(t_i)$ is close to zero within an acceptable range.

After the fluid parcel reaches the wellbore, it continuously moves upward along wellbore in the later time step until reaching the sampler. In this situation, the $M_f(t_i)$ is always negative. The method turns to step 25 to calculate the location of the fluid parcel. The total mass produced from the formation and located below the parcel front at the time $t_i$ is:

$$M_{ws}(t_i)=M_p(t_i)-M_f(t_0) \tag{20}$$

If the wellbore grids are $z_0, z_1, z_2, \ldots, z_L$ from the bottom to the top and the parcel front location is between grids $z_{k-1}$ and $z_k$, the parcel front location $z_{si}(t_i)$ inside the wellbore at the time $t_i$ can be obtained from the following mass balance equation:

$$M_{ws}(t_i) = \sum_{j=1}^{k-1} A_{j-1,j}\rho_{wj-1,j}(t_i)(z_j - z_{j-1}) + A_{k-1,k}\rho_{wk-1,j}(t_i)[z_{si}(t_i) - z_{k-1}] \tag{21}$$

where $\rho_{wj-1,j}(t_i)$ and $A_{j-1,j}$ are the fluid density and fluid channel cross-section area between the grids $z_{j-1}$ and $z_j$ in the wellbore, respectively. The pressure history of the fluid parcel at $z_{si}(t_i)$ is subsequently updated by interpolating the pressures at the grids $z_{k-1}$ and $z_k$ in the wellbore in step 26.

Step 27 makes judgment whether the parcel front location $z_{si}(t_i)$ reaches the sampler location $z_s$. If the fluid parcel reaches the sampler, the pressure history construction can be terminated. Otherwise, the simulation advances to another time step and goes back to step 20.

Figure 4:
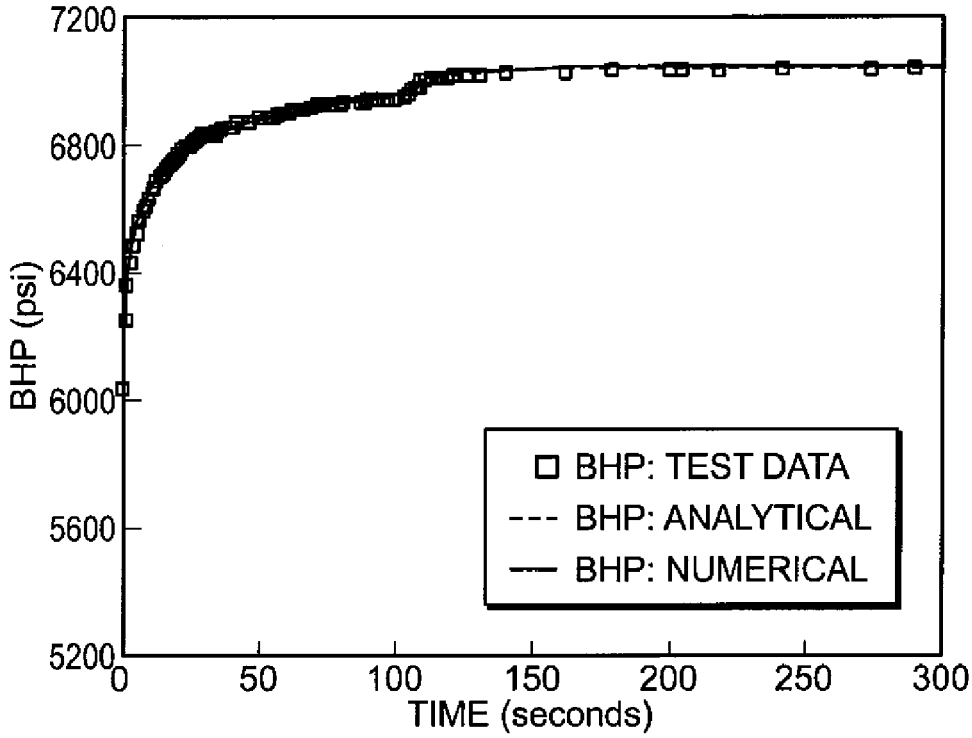
FIG. 4 illustrates a history matching of BHP using the analytical solution disclosed in the U.S. patent application Ser. No. 11/674449 and a numerical method disclosed in the present application.

The workflow and methods outlined above have been implemented in a simulator to reconstruct the entire pressure history of a fluid sample in a well test. FIG. 4 shows the bottom-hole pressure (BHP) measurements as well as the simulation results from the analytical solutions disclosed in the U.S. patent application Ser. No. 11/674449 and the numerical model disclosed in this invention in an actual closed chamber test. Based on the interpretation methods disclosed in the U.S. patent application Ser. No. 11/674449, the initial reservoir pressure is estimated to be 6055 psi, permeability is 1800 md, skin parameters $s_I$=7, $s_E$=1, $t_s$=90 sec. It can be seen that the lowest bottom-hole pressure after the bottom-valve is opened in the test is above 5044 psi. The actual wellbore pressure drop magnitude of 1011 psi at the initial time of the test is obtained. The quality of the fluid samples captured at the later test time can be qualitatively quantified by this early pressure drop magnitude in the test.

Figure 5:
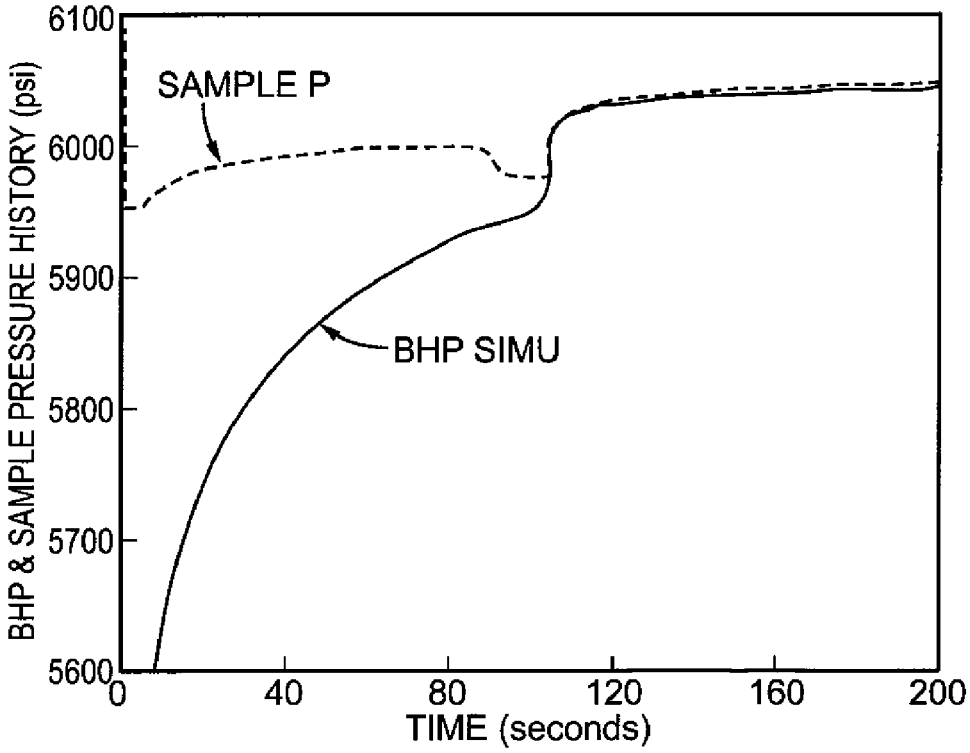
FIG. 5 illustrates a comparison of the BHP and the pressure history of the fluid parcel that is captured in the sampler according to the present application.

The more accurate method to evaluate the quality of the fluid samples taken in this test is to track back the pressure history of the fluid parcel that would have been taken into the sampler if existing. The sampler was assumed to be 10 ft below the bottom-hole pressure gauge and the well was assumed to be shutting in at 104 seconds of the test. FIG. 5 compares the BHP and reconstructed pressure history of the fluid sample parcel during the entire test. In general, the fluid parcel pressure follows the trend of the BHP with relatively higher magnitude at specific time of the test. Four distinct periods of pressure transients existed for the fluid parcel along with its moving from the original location inside formation to the sampler.

The first pressure transient occurred at the commencement of the test, at which the pressure of the fluid parcel dropped to a minimum value but in a much more moderate magnitude than the BHP. That nearly instant drop of the pressure is due to the reduction of the BHP inside wellbore after the opening of the bottom-valve and relatively short distance of the fluid parcel to the wellbore (about 2 ft away from the sandface). In that situation, the BHP affected the formation pressure very fast.

The second period of the pressure transient involves two competing processes in determining the fluid parcel pressure. Because the parcel continuously moved from the original location inside the formation to the wellbore, its pressure had a decreasing tendency. On the other hand, as the BHP continuously rose during the test due to increasing hydrostatic pressure inside the wellbore, the pressure of the fluid parcel also increased. It is evident that the latter process was dominant in the subsequent time of this period, resulting in increasing pressure of the fluid parcel.

The third period started at about 91 seconds of the test when the fluid parcel reached the sandface and ended when the well was assumed to be shut-in at about 104 seconds. The pressure of the fluid parcel had a sudden dip. This was because the positive skin imposed at sandface in the simulation model made the bottom-hole pressure at the middle of the production zone smaller than the pressure at the sandface. Similar to the second transient period, the fluid parcel also was affected by the two opposite pressure tendencies in this period. The rising BHP made the fluid parcel pressure increase while the moving up of the parcel reduced the hydrostatic pressure. It is obvious that the two tendencies had balanced effect in this test, making the parcel pressure relatively stable within the period.

The final period of the pressure transient began when the well was shut in. Because the fluid parcel had a very small movement during this period, the pressure was dominated by the BHP variation. FIG. 5 also shows that the fluid parcel pressure closely followed the BHP with a slightly higher value due to the 10 ft. deeper location.

Although the pressure history of the fluid parcel around the sampler was relatively complicated, it was always much higher than the BHP, particularly at the initial test time. That reconstructed pressure history of the fluid samples provides much more accurate criteria for quantifying whether there was a phase change in the fluid samples.

Figure 6:
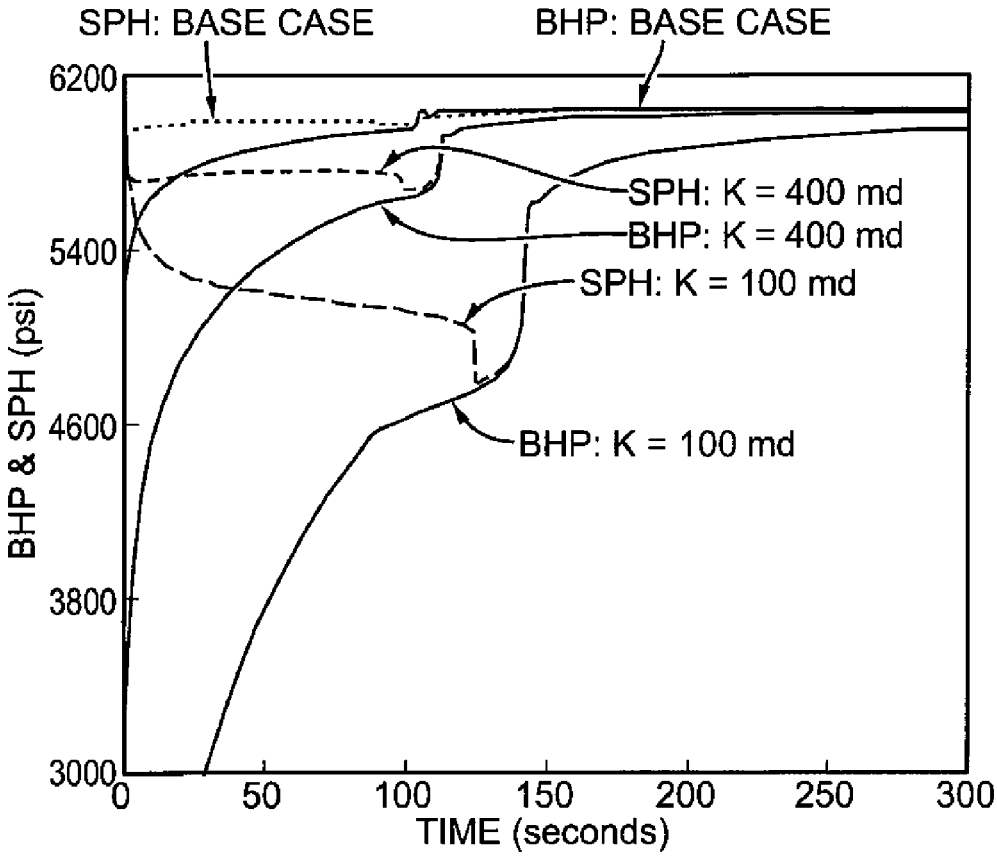
FIG. 6 illustrates an effect of permeability on the BHP and reconstructed pressure history of the fluid samples with sandface shut-in at t=104, 114 and 145 seconds for permeability of 1800 md, 400 md and 100 md, respectively.

FIG. 6 shows the effect of permeability variation on BHP and the reconstructed fluid sample pressure history (SPH) when other formation and well properties do not change. We assume the well is shut in at the time of 104, 114 and 125 seconds for the case of 1800 md, 400 md and 100 md, respectively. It can be seen that although BHP is sensitive to permeability variation, permeability has to reduce below 400 md to have substantial effect on BHP history. For permeability of 400 md, the minimum BHP drops to 2500 psi in the test comparing to more than 5000 psi in Base Case of 1800 md permeability.

However, the BHP recovers to above 5000 psi in 25 seconds after the test starts. In that situation, it is expected the phase change in the bottom-hole hydrocarbon should not be very severe. If permeability is even lower, for example, permeability is 100 md as shown in green lines of FIG. 6, the minimum BHP can be as low as 375 psi. More importantly, the low BHP lasts a much longer time in the test. That potentially may induce non-negligible phase change inside wellbore.

It can be seen from FIG. 6, that the reconstructed pressure history of the fluid samples is higher than corresponding BHP during the entire time of the test although the pressure history may drop to a low level for low permeability formation. For high permeability formation, the reconstructed pressure history shows four characteristics periods similar to that in FIG. 4:

- The reconstructed pressure of the fluid samples drops to a minimum value at the beginning of the test;
- The reconstructed pressure of the fluid samples recovers from the minimum value as the fluid parcel moves toward wellbore;
- The reconstructed pressure of the fluid samples has a dip due to passing the positive skin at the sandface and leaving the formation into wellbore;
- The reconstructed pressure of the fluid samples closely matches BHP during the shut-in time if the sampler is below the bottom valve.

However, the reconstructed pressure history of the fluid samples does not reach the minimum at the initial test for the case of K=100 md. Instead, it gradually decreases as the parcel moves to wellbore. The minimum pressure in the entire history occurs at the time of the parcel just leaving the formation and entering the wellbore. This feature is especially helpful for fluid sampling in low permeable formations. The reason is that when the parcel reaches the wellbore at the late time of the test, the BHP already recovers substantially. Therefore, the minimum of the pressure history should not be significantly less than formation pressure. As shown in FIG. 6, the minimum of the reconstructed pressure history for K=100 md is much higher than the corresponding minimum of the BHP. Specifically, the minimum of the fluid sample pressure is above 3800 psi as compared to about 300 psi of the minimum BHP for the permeability of 100 md formation.

Figure 7:
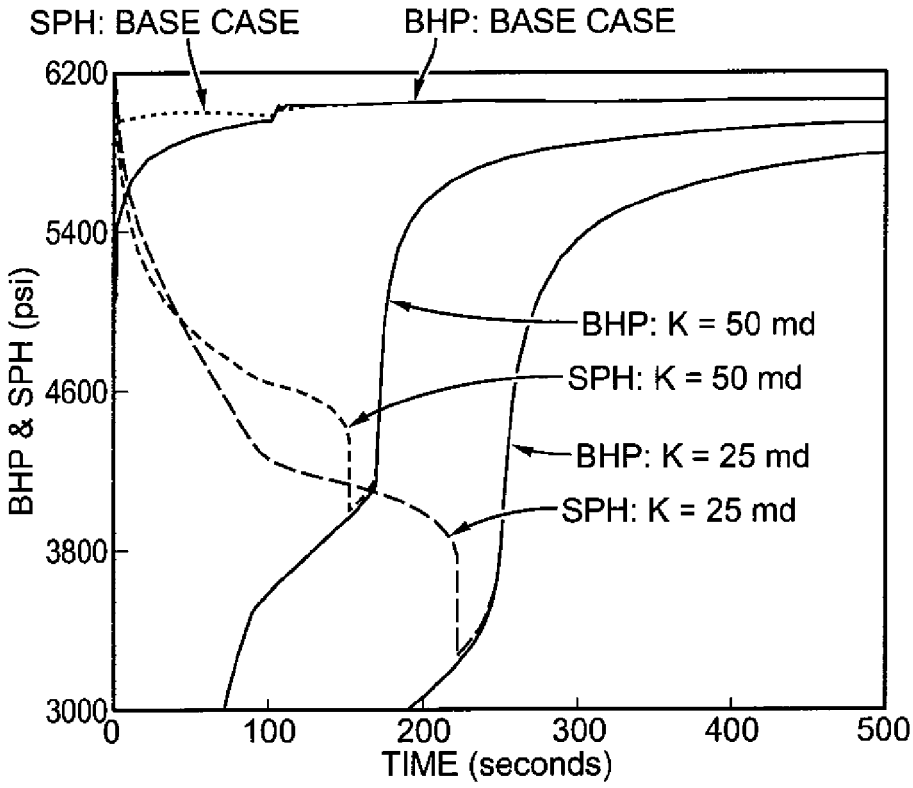
FIG. 7 illustrates an effect of permeability on BHP and reconstructed pressure history of the fluid samples with sandface shut-in at t=104, 170 and 250 seconds for permeability of 1800 md, 50 md and 25 md, respectively

Further reduction of formation permeability will result in longer time of low BHP history as shown in FIG. 7, in which the minimum BHP already reaches the lowest possible value (air chamber pressure plus hydrostatic pressure from the liquid cushion) when permeability is 25 md. The corresponding minimum of the pressure history dips to 3250 psi, which may be below the bubble point pressure. Although this minimum of the pressure history in the fluid samples is not very low and rises dramatically from the minima after the well is shut-in, it is possible this low pressure history will affect the quality of down-hole fluid sampling for the test if the bubble or dew point pressure is higher than 3250 psi. That simulation result demonstrates the importance of using the reconstructed pressure history of the fluid sample to quantify its quality in the fluid sampling.

Although a CCT example was used to illustrate the invention herein, those skilled in the art should appreciate, the technique disclosed herein can be used to quantify sample quality from test while drilling, wireline formation test or conventional DST with slight variations of the mathematical models.

Much of the preceding description can be carried out by way of a computer, or similar device. Thus, such can be embodied in a computer program that is stored on a medium that is readable by a computer, and which will instruct the computer to perform steps. Some of the mediums that are available for storing programs along those lines are a CD, a hard drive, a flash memories, a floppy disks, a zip disk, and the like.

The preceding description relates to exemplary embodiments and examples relating to the present invention, and in no way should be interpreted as limiting the claims herein beyond the literal claim language.

It is claimed:

1. A method to determine quality of a downhole fluid sample, comprising:

locating a toolstring comprising a drill stem testing device downhole, the drill stem testing device having a chamber for collecting fluid samples;

opening the chamber to induce flow of the fluid sample into the chamber and subsequently closing the chamber to trap the fluid sample;

measuring at least one selected from the following list: a pressure inside a wellbore and a pressure inside the drill stem testing device;

obtaining properties including at least one selected from the following list: initial pressure inside a formation, permeability of a formation, and skin factor;

reconstructing a pressure history of the fluid sample by tracking the locations and pressures of the fluid sample from the formation into the chamber based on at least the obtained properties; and determining whether the pressure history of the fluid sample dropped below a critical pressure from the formation into the chamber;

the critical pressure being a bubblepoint pressure for a liquid and a dewpoint pressure for a gas.

2. The method of claim 1, comprising:

determining if the fluid sample from the formation into the chamber has contained multiphase fluid.

3. The method of claim 1, comprising:

determining if the fluid sample has included predetermined unwanted fluids.

4. The method of claim 1, comprising:

performing an integrated simulation, the simulation comprising;

modeling fluid transport in the formation;

modeling fluid transport in the wellbore;

modeling fluid transport in the tool string; and tracking locations and pressures of the fluid sample in the formation, in the wellbore, and in the toolstring.

5. The method of claim 1, comprising:

discretizing the formation;

discretizing the wellbore;

discretizing the tool string, and setting up initial and boundary conditions.

6. The method of claim 1, comprising:

determining a flow rate during a wireline formation test by measuring a pumpout volume.

7. The method of claim 1, comprising:

determining a flow rate during a well test by at least one selected from the following: down-hole measurements and surface measurements.

8. The method of claim 1, comprising:

calculating a flow rate from pressure measurements in an air chamber of a closed chamber test.

9. The method of claim 4, comprising:

setting up initial and boundary conditions.

10. A computer readable medium that includes thereon a program readable by a computer that instructs the computer to determine quality of a fluid sample based on measurement of at least one selected from the following list: a pressure inside a wellbore and a pressure inside a drill stem testing device of a toolstring; and properties including at least one selected from the following list: initial pressure inside a formation, permeability of a formation, and skin factor;

the computer performing steps, comprising;

reconstructing a pressure history of the fluid sample by tracking the locations and pressures of the fluid sample from the formation to chamber in the drill stem testing device, based on at least the obtained properties; and determining whether the pressure history of the fluid sample from the formation to the drill stem testing device dropped below a critical pressure;

the critical pressure being a bubblepoint pressure for a liquid and a dewpoint pressure for a gas.

11. The computer readable medium of claim 10, the steps comprising:

determining if the fluid sample from the formation into the chamber has contained multiphase fluid.

12. The method of claim 10, the steps comprising:

determining if the sample flow has contained predetermined unwanted fluids.

13. The computer readable medium of claim 10, the steps comprising:

performing an integrated simulation, the simulation comprising;

modeling fluid transport in the formation;

modeling fluid transport in the wellbore;

modeling fluid transport in the tool string; and tracking locations and pressures of the fluid sample in the formation, in the wellbore, and in the toolstring.

14. The computer readable medium of claim 10, the steps comprising:

discretizing the formation;

discretizing the wellbore;

discretizing the tool string, and setting up initial and boundary conditions.

15. The computer readable medium of claim 10, the steps comprising:

determining a flow rate during a wireline formation test by measuring a pumpout volume.

16. The computer readable medium of claim 10, the steps comprising:

determining a flow rate during a well test by at least one selected from the following: down-hole measurements and surface measurements.

17. The computer readable medium of claim 10, the steps comprising:

calculating a flow rate from pressure measurements in an air chamber of a closed chamber test.

18. The computer readable medium of claim 13, the steps comprising:

setting up initial and boundary conditions.

19. A method to determine quality of a downhole fluid sample, comprising:

locating a toolstring comprising a drill stem testing device downhole, the drill stem testing device having a chamber for collecting fluid samples;

opening the chamber to induce flow of a fluid sample into the chamber and subsequently closing the chamber to trap the fluid sample;

discretizing the formation;

discretizing the wellbore;

discretizing the tool string, and setting up initial and boundary conditions;

calculating a total mass in the wellbore and in the tool string, below a sampler at an initial time;

conducting a first simulation run to obtain at least the following: a pressure and velocity distribution inside the wellbore and inside the drill stem testing device of the tool string, a cumulative mass of the fluid sample that passes through a location in the sampler at the time of sampling, and a total mass in the wellbore and in the tool string below the sampler at the time of the sampling;

calculating total mass produced from the formation ahead of a fluid sample captured in the sampler;

calculating initial locations of the fluid sample that is captured in the sampler at a time later than the initial time;

conducting a second simulation run to track pressure history of the fluid sample from an initial location inside the formation to a location at the sampler.

20. The method of claim 19, wherein the second simulation run comprises:

discretizing the formation;

discretizing the wellbore;

discretizing the tool string, and establishing the following: initial and boundary conditions, initial fluid sample location, total mass in the formation between the initial fluid sample location and a sandface, and initial fluid sample pressure;

advancing a time step to calculate a pressure and a velocity distribution inside the formation, the wellbore, and the tool string, at another time;

calculating a total mass produced from the formation and a total mass in the formation ahead of the fluid sample;

determining if the total mass in the formation ahead of the fluid sample is less than or equal to zero, and updating a location of the fluid sample based on the total mass produced from the formation.

21. The method of claim 19, comprising:

updating the location of the fluid sample in the formation and updating the pressure of the fluid sample in the formation, the updating being contingent on a determination that the total mass in the formation ahead of the fluid sample is greater than zero.

22. The method of claim 19, comprising:

updating determination of the location of the fluid sample in the wellbore and in the tool string, and updating the determination of the pressure of the fluid sample in the wellbore, the updating being contingent on a determination that the total mass in the formation ahead of the fluid sample is equal to or less than zero.

23. The method of claim 22, comprising:

determining if a front location of the fluid sample is equal to a height of the fluid sampler; and if the fluid sample front location is determined not to be equal to the height of the fluid sampler, advancing a time step to calculate a pressure and velocity distribution in the formation and in the wellbore and tool string.

* * * * *